US005323510A

United States Patent [19]

Redding et al.

[11] Patent Number: 5,323,510

[45] Date of Patent: Jun. 28, 1994

[54] VACUUM CLEANER HAVING IMPROVED STEERING FEATURES

[76] Inventors: Glenn K. Redding, 12540 Quail Ridge Rd., Gulfport, Miss. 39503; Kristen G. Sprow-Byrd, 3907 Belmede Pl., Gulfport, Miss. 39507; Michael D. Collins, 1550 E. 2nd St., Apt. D13, Pass Christian, Miss. 39571; James R. Hunter, Jr., 1550 E. 2nd St., Apt. S116, Pass Christian, Miss. 39571; Gary A. Miller, 15283 Woody Dr., Gulfport, Miss. 39503; Christopher A. Robinette, 1490 Valota Rd., Redwood City, Calif. 94061; Walter L. Webb, 615 Parkwood Dr., Long Beach, Miss. 39560

[21] Appl. No.: 89,978

[22] Filed: Jul. 9, 1993

[51] Int. Cl.[5] ..... A47L 9/32

[52] U.S. Cl. ..... 15/411; 15/339; 15/323; 280/47.11

[58] Field of Search ..... 15/339, 410, 340.2, 15/411; 280/47.11

[56] References Cited

U.S. PATENT DOCUMENTS

| | | |
|---|---|---|
| 882,574 | 3/1908 | Moukos . |
| 959,721 | 5/1910 | Cummings et al. . |
| 981,893 | 1/1911 | Spencer . |
| 1,072,607 | 9/1913 | Guthorn . |
| 1,086,367 | 2/1914 | Hope . |
| 1,102,142 | 6/1914 | Cooley . |
| 1,104,148 | 7/1914 | Spencer . |
| 1,139,736 | 5/1915 | Stabel . |
| 1,161,908 | 11/1915 | Tice . |
| 1,318,881 | 10/1919 | Kelley . |
| 1,355,553 | 10/1920 | Goughnour . |
| 1,672,250 | 6/1928 | Felton . |
| 1,838,481 | 12/1931 | Gudka . |
| 1,900,465 | 3/1933 | Riebel, Jr. . |
| 1,918,713 | 7/1933 | Ponselle . |
| 1,940,609 | 12/1933 | Simpson . |
| 2,038,697 | 4/1936 | Winslow . |
| 2,162,313 | 6/1939 | McCabe et al. . |
| 2,245,151 | 6/1941 | Martinet . |
| 2,293,457 | 8/1942 | Dow . |
| 2,496,813 | 2/1950 | Peterson . |
| 2,610,351 | 9/1952 | Lilly . |
| 2,613,388 | 10/1952 | Walker . |
| 2,619,671 | 12/1952 | Humphrey . |
| 2,620,506 | 12/1952 | Weiland . |
| 2,637,062 | 5/1953 | Sutton et al. . |
| 2,671,927 | 3/1954 | White . |
| 2,730,480 | 11/1951 | Brown . |
| 2,734,215 | 2/1956 | Wilson . |
| 2,844,841 | 7/1958 | Bergquist . |
| 2,974,347 | 3/1961 | Seyfried . |
| 3,102,289 | 9/1963 | Norris . |
| 3,189,933 | 6/1965 | Smith . |
| 3,205,528 | 9/1965 | Fromknecht et al. . |
| 4,266,317 | 5/1981 | Duda . |
| 5,060,342 | 10/1991 | Brazier . |
| 5,075,921 | 12/1991 | Gleadall ..... 15/410 X |

FOREIGN PATENT DOCUMENTS

| | | | |
|---|---|---|---|
| 468920 | 7/1937 | United Kingdom | 15/410 |

*Primary Examiner*—Chris K. Moore
*Attorney, Agent, or Firm*—Jones & Askew

[57] ABSTRACT

An upright steerable vacuum cleaner is provided, which includes the use of a pivotable cylindrical motor housing, as well as a universal joint which is attached to the motor housing, such that twisting at the upper body of the vacuum cleaner clockwise causes the base of the unit to turn right, twisting in the opposite direction causes if to turn left.

7 Claims, 5 Drawing Sheets

VACUUM CLEANER HAVING IMPROVED STEERING FEATURES

TECHNICAL FIELD

This invention relates in general to vacuum cleaners, and particularly relates to vacuum cleaners which have an improved "steering" feature.

BACKGROUND OF THE INVENTION

In the field of vacuum cleaners, a need has been recognized to provide vacuum cleaners which have improved maneuverability features. The prior art is replete with powered upright vacuum cleaners and vacuum cleaners which include L-shaped nozzles which allow the operator to vacuum around objects such as chair legs.

However, a need still exists for an upright vacuum cleaner which has improved maneuverability features not provided by the prior art.

SUMMARY OF THE INVENTION

The present invention provides an improved upright vacuum cleaner which has improved maneuverability features, and which is cost-effective to produce, operate, and maintain.

It is an object of the present invention to provide an improved vacuum cleaner.

It is an object of the present invention to provide a vacuum cleaner which has improved cleaning features.

It is an object of the present invention to provide a vacuum cleaner which has improved maneuverability features.

It is an object of the present invention to provide a vacuum cleaner which is easy to operate.

It is an object of the present invention to provide a vacuum cleaner which is cost-effective to produce.

Other objects, features, and advantages of the present invention will become apparent upon reading the following detailed description of the preferred embodiment of the invention when taken in conjunction with the drawing and the appended claims.

DETAILED DESCRIPTION OF THE PREFERRED EMBODIMENT

Figure 1:
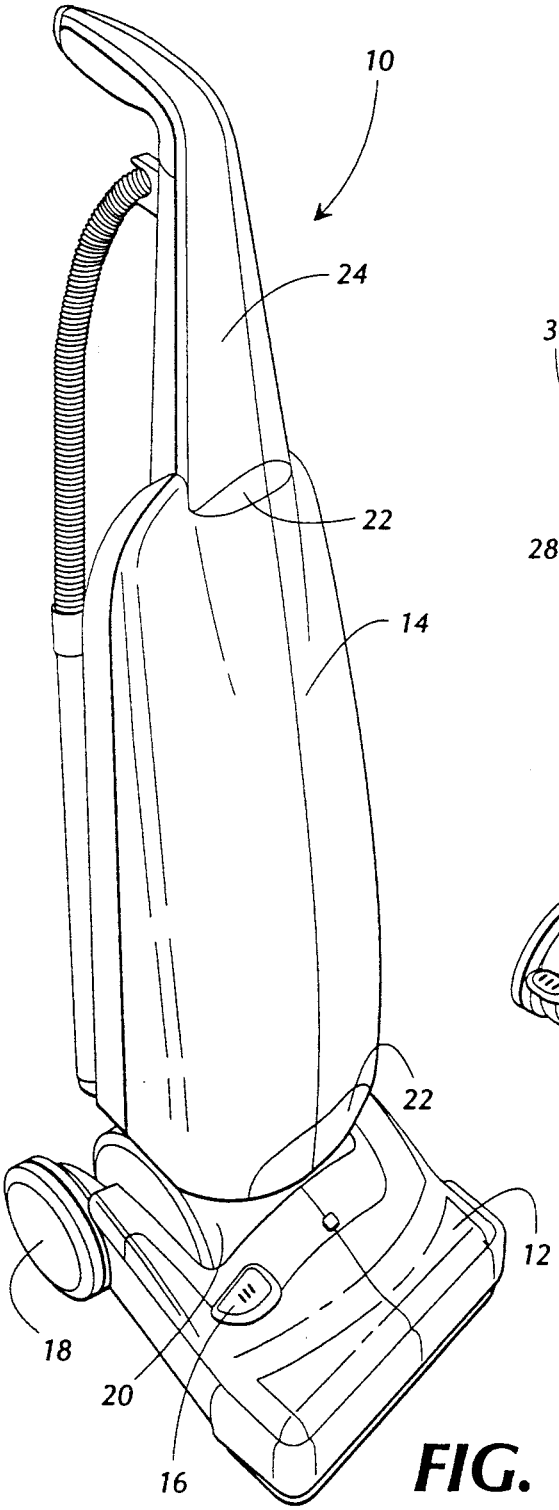
FIG. 1 is a front, right, pictorial view of a first embodiment of an upright vacuum cleaner according to the present invention.

Referring now to the Figures, in which like numerals indicate like parts throughout the several views, FIG. 1 illustrates an upright vacuum cleaner 10 including a lower base 12 and an upright body 14. The base 12 includes a height adjustment switch 16, and a pair of rear wheels 18. The base 12 also includes a cylindrically-shaped motor housing 20. The upright body 14 may include a light 22, and an upright handle portion 24.

Figure 2:
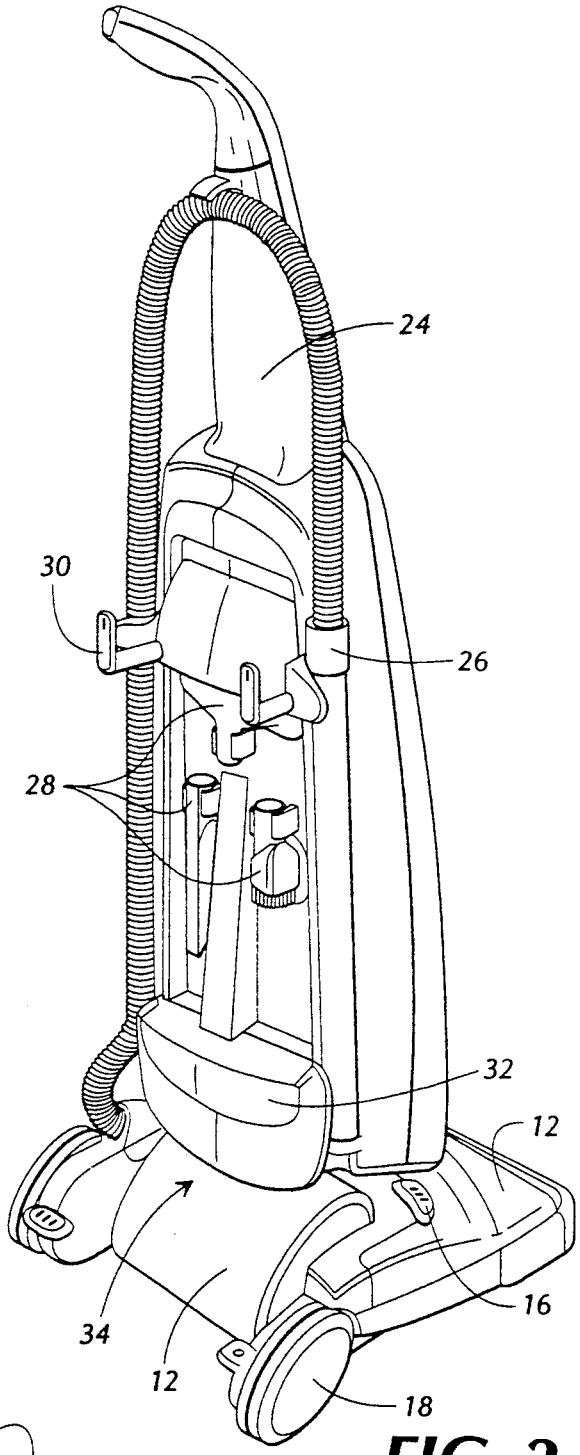
FIG. 2 is a rear, right view of the upright vacuum cleaner illustrated in FIG. 1.

Referring now also to FIG. 2, hose assembly 26, tools 28, cord wrap flanges 30, 32, and upper and lower universal joint subassembly 34 are shown.

Figure 3:
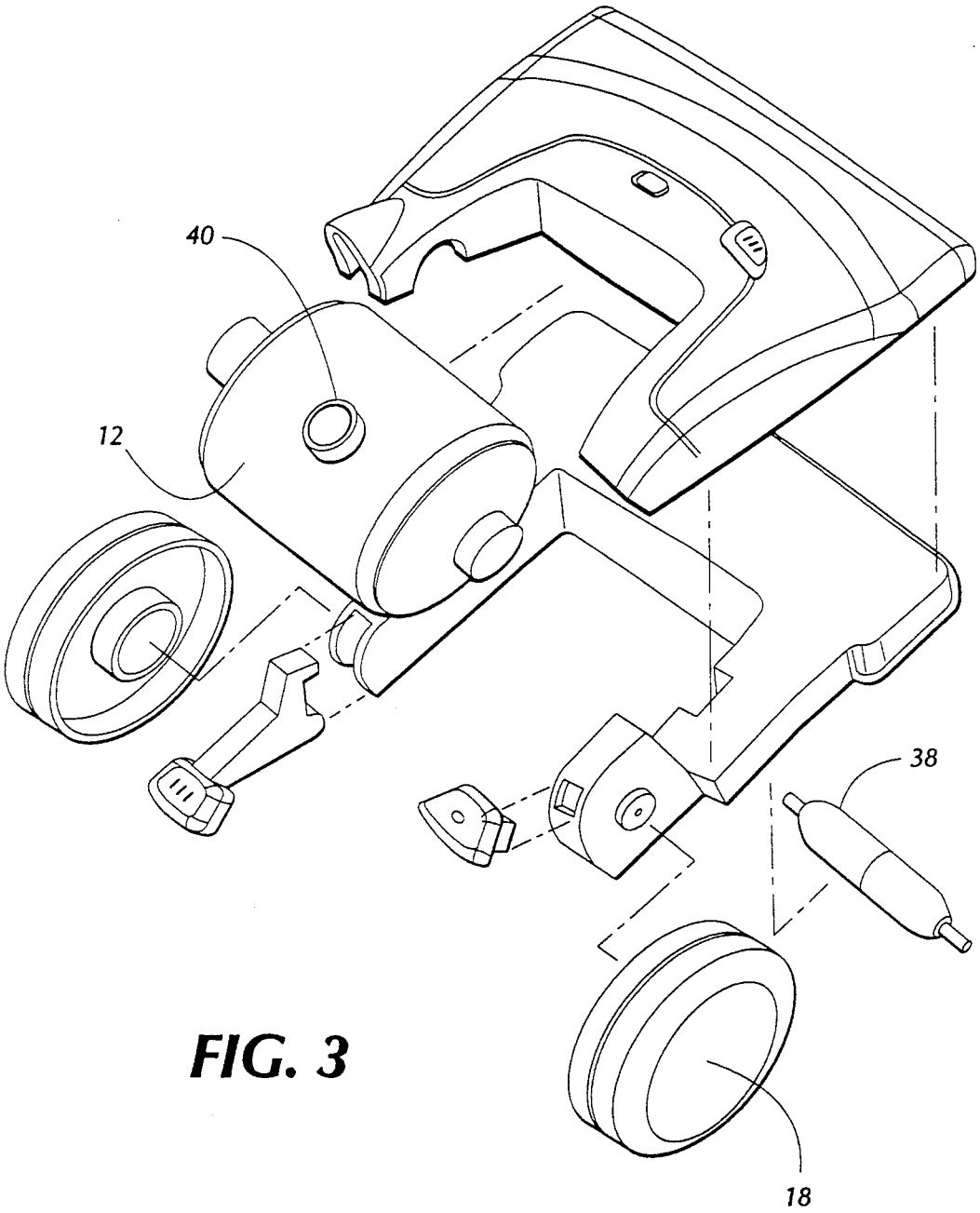
FIG. 3 is an exploded view illustrating some elements of the base of the vacuum cleaner shown in FIG. 1.
Figure 4:
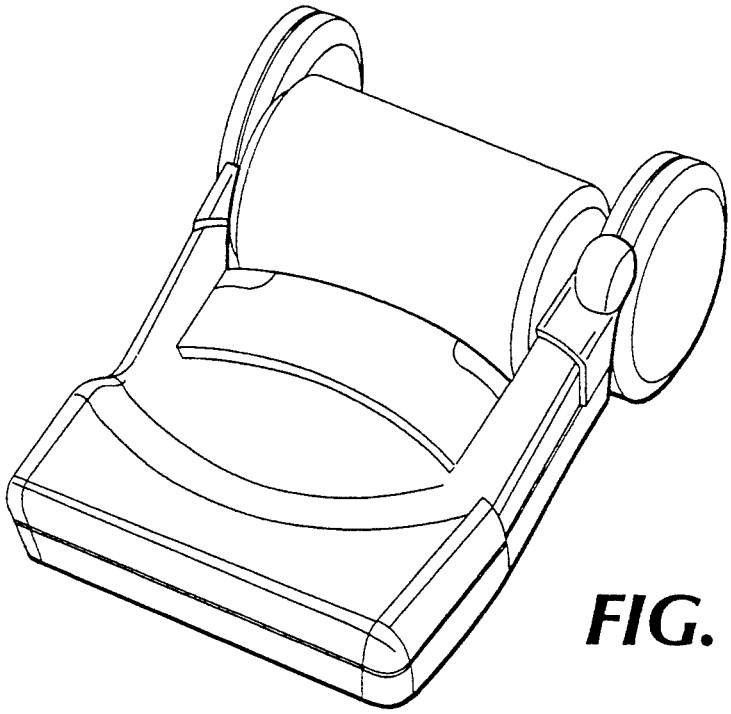
FIGS. 4 and 5 are additional embodiments of a base of the vacuum cleaner according to the present invention, including an alternate preferred universal joint assembly.
Figure 5:
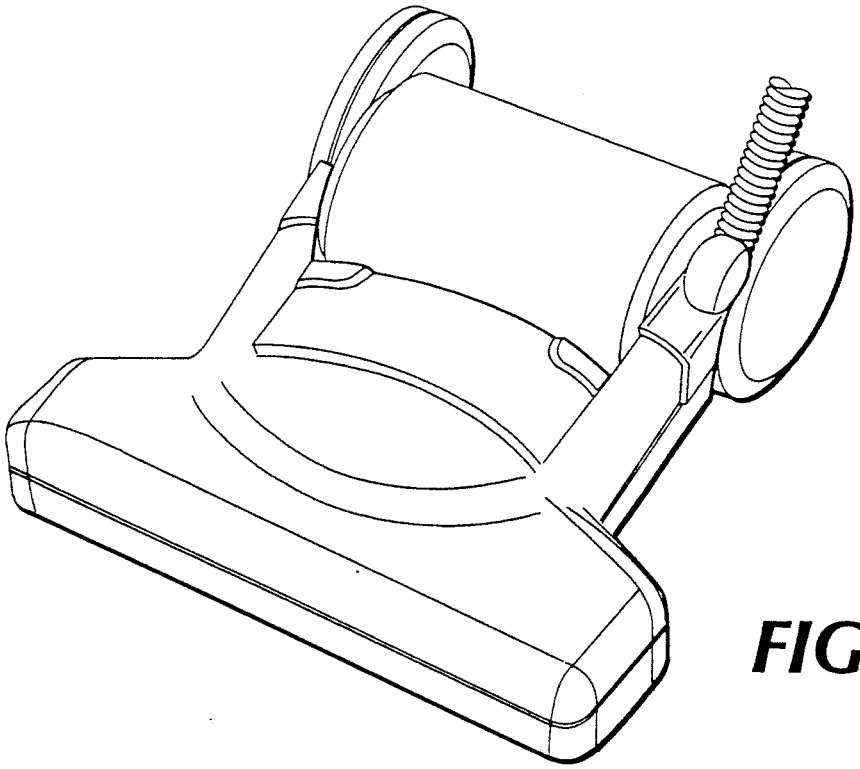

Referring now to FIG. 3, some of the previously discussed elements are illustrated, along with a front roller Referring now to FIGS. 4 and 5, various base configurations are shown.

Referring now to FIGS. 6–9, a side view of one embodiment of the universal joint assembly 34 is illustrated. Operation of this assembly 34 is now discussed. As may be understood, an upper universal joint member 44 is rotatably mounted relative to lower universal joint member 40 along a pivoting axis P. These members are joined by an intermediate collar 42 such that air can be transferred from member 40 to member 44. The upper universal joint member 44 is rigidly attached relative to body member 14 and facilitates the transfer of air into the body through an internal air channel. Lower universal joint member 42 is likewise rigidly affixed relative to cylindrically-shaped motor housing 20 and receives air from a motor within the housing 20. The motor housing 20 is pivotably mounted relative to the base 12 of the vacuum cleaner, along substantially horizontal axis X. Intermediate collar 42, in the embodiment shown is composed of two joined together by fasteners such as is known in the art.

As may be understood, the lower universal joint member 40 has an annular tapered "male" portion 50 8) which fits within an annular tapered "female" (see FIG. 9) of the upper universal joint member 44. The intermediate collar 42 locks these two elements 40, 44, together such that they may rotate relative to each other axis P (see FIG. 6) described above, and at the same time air may be transferred from member 40 to member 44.

The intermediate linking collar 42, when in place, is rotatably mounted to the lower universal joint member by means of outwardly-directed annular ribs 54 (see FIG. 8) of the lower universal member mating with a single annular ring (not shown) inside the collar 42, allowing the collar to rotate along axis P relative to the universal joint member 40, but limiting movement of the two members along axis P. By a similar interlocking relationship provided by outwardly-directed annular ribs 56 of the upper universal member mating with mating with a single rib (not shown) in the collar, the collar 42 is rotatably mounted relative to the upper universal joint member 44, with the two elements allowed to rotate relative to each other axis L.

Figure 10:
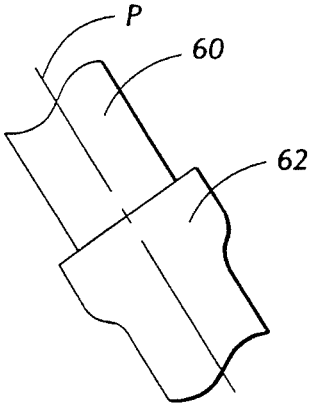
FIG. 10 is an illustrative view of an alternate joint member not including the use of an intermediate collar.
Figure 8:
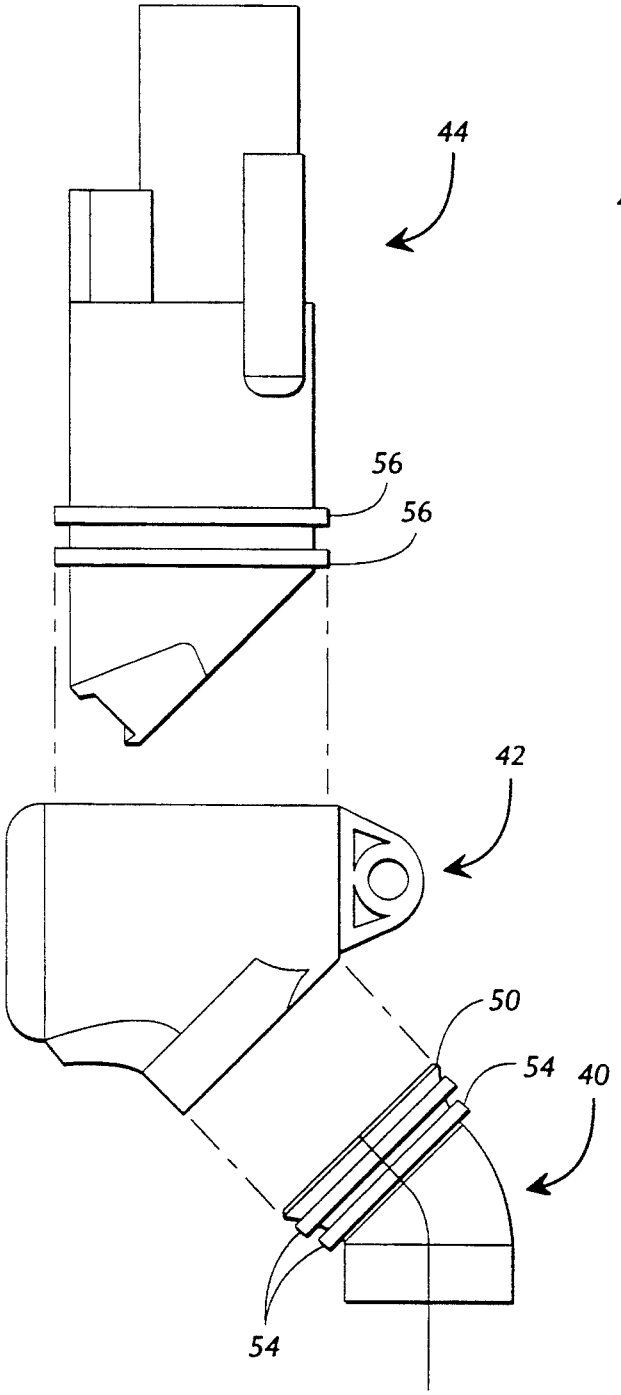
FIG. 8 is right side exploded view of that shown in FIG. 7.
Figure 9:
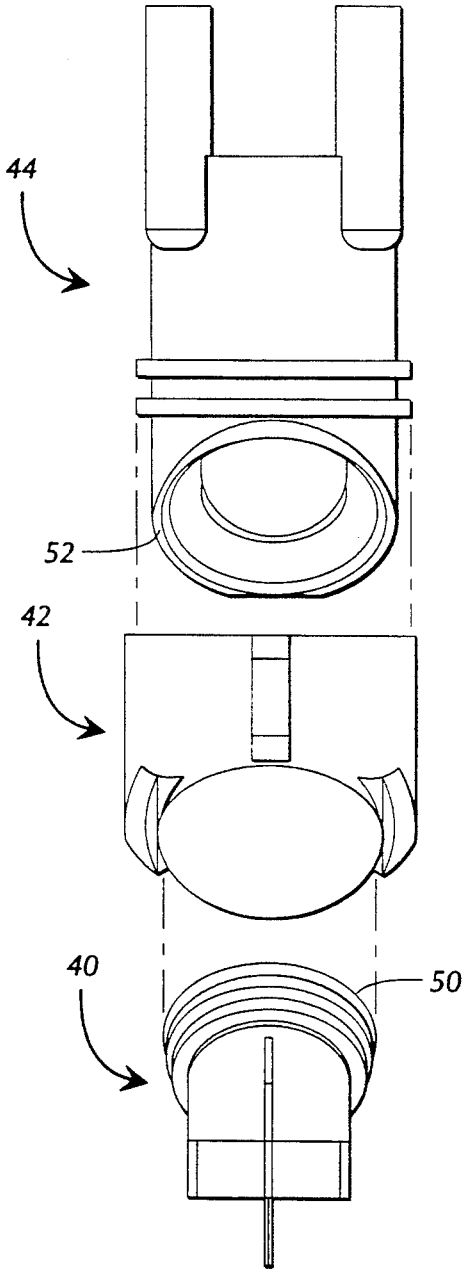
FIG. 9 is a front exploded view of that shown in FIG. 7.

Other universal joint configurations are also contemplated under the present invention. For example, as shown in FIG. 10 an alternate universal joint configuration is contemplated in which, for example, a lower universal member 62 (which is assembled from two halves and attached by fasteners as known in the art) interlocks with an upper universal joint member 60 without the use of a collar. The upper and lower members would be rotatably interlocked by the use of interlocking annular ribs on the two members providing interlocking of the members as described above. The lower universal joint member, being a "female" 62, accepts and surrounds the lower end of the upper joint member, being a "male" member, providing for rotational or relative pivoting movement of the two members about an axis such as "P", described above, with travel the axis being limited by the interference of the annular Member 62 is attached to the pivoting motor housing and member 60 is attached to the upper body in a manner similar to that described above.

Figure 6:
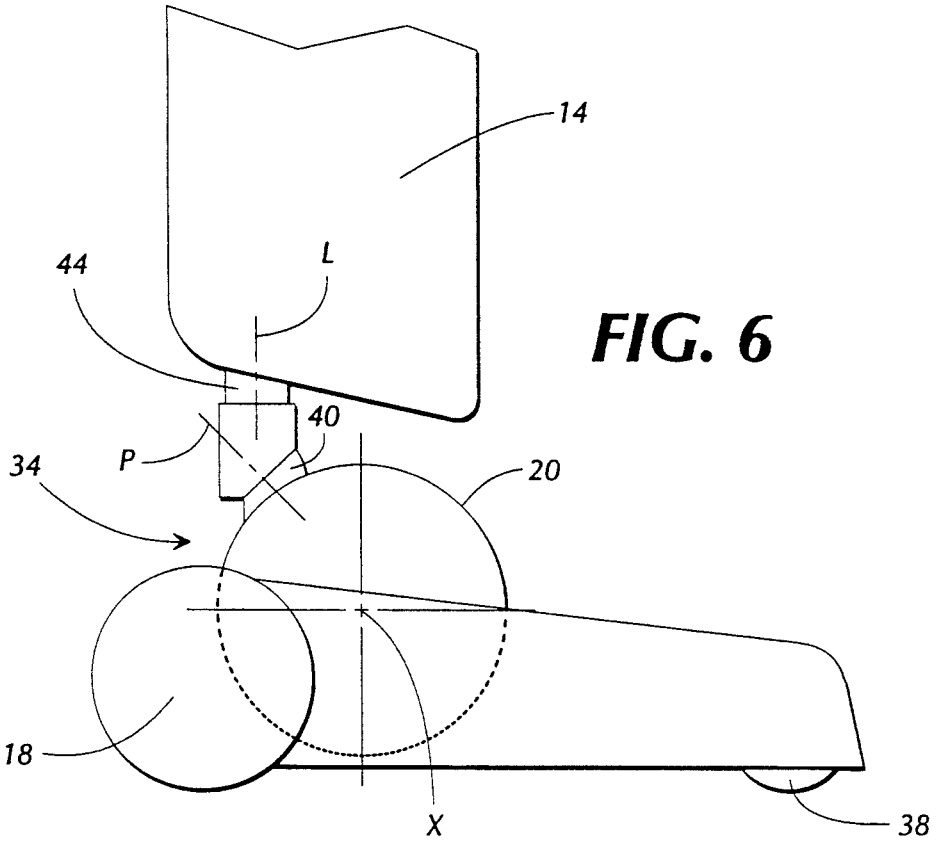
FIG. 6 is a side illustrative view of that shown in FIG. 4.
Figure 7:
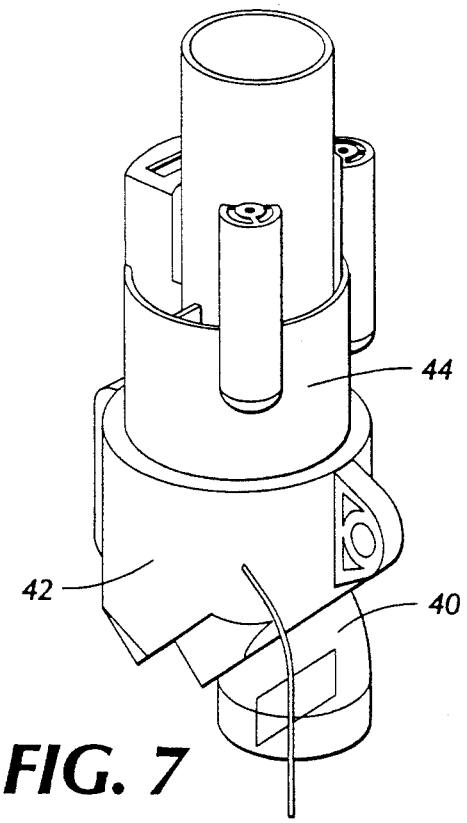
FIG. 7 is an upper right pictorial view of the universal joint being part of the present invention.

As may be understood, when the operator operates the upright vacuum cleaner, the operator first pivots the upright body 14 from its relatively vertical position illustrated in FIG. 6 to a more inclined position. As the vacuum cleaner is operated, if the operator is pushing the vacuum cleaner generally forward, the operator may "twist" the handle cause the handle and body to turn in a clockwise or counterclockwise direction substantially along their longitudinal axes. In the instance of the configuration illustrated in FIG. 6, if the operator twists the body 12 in a clockwise direction along its longitudinal axis, the base 12 tend to turn to the right as it is being pushed forwardly. Likewise, if the body 14 is rotated in a counter-clockwise direction along their longitudinal axis, the base 12 will tend turn leftwardly as it is being pushed in a forward direction. As may be understood, such a configuration is an improvement over the prior art in that by a continuation of pushing and twisting the handle of the vacuum cleaner, the base may be simply and easily maneuvered in a novel manner.

The air flow throughout the unit is as follows. A motor within the motor housing 20 is energized, such that air is drawn from beneath the base 12, into the motor housing through a suitable connection, into the lower universal member, into the upper universal member, and into the body and into a filtration bag or canister.

While this invention has been described in specific detail with reference to the disclosed embodiments, it will be understood that many variations and modifications may be effected within the spirit and scope of the invention as described in the appended claims.

What is claimed is:

1. A vacuum cleaner, comprising:

a base;

a motor housing pivotally attached to said base about a substantially horizontal first axis;

a substantially upright elongate body portion including a handle portion; and a universal joint assembly defining an air channel capable of facilitating the flow of air from said base to said body portion, said joint assembly itself comprising;

a) an upper universal joint portion rigidly attached to said body portion;

b) a lower universal joint portion rigidly affixed to said motor housing; and c) link means for linking said upper universal joint member to said lower universal joint member such that said upper body member may be rotated along a second axis relative to said motor housing, such that twisting said upper body member clockwise along said longitudinal axis while pushing said vacuum cleaner forward tends to cause said vacuum cleaner base to turn right, and twisting said upper body member counterclockwise along said longitudinal axis while pushing said vacuum cleaner forward tends to cause said vacuum cleaner base to turn right.

2. The vacuum cleaner as claimed in claim 1, wherein said motor housing may be selectively locked and unlocked relative to said base such that said pivoting relationship between said motor housing and said base may be correspondingly disallowed and allowed.

3. The vacuum cleaner as claimed in claim 1, wherein first pivoting axis between said motor housing and said base substantially orthogonal to said second pivoting axis between said motor housing and said body of said vacuum cleaner.

4. The vacuum cleaner as claimed in claim 1, wherein said link means is a collar which fits over and locks to said upper and lower universal members.

5. The vacuum cleaner as claimed in claim 4, wherein said collar is attached to said upper universal member by an annular locking relationship, and wherein said collar is attached to said lower universal joint by an annular locking relationship, such that said twisting action causes said rotate along an axis relative to at least one of said upper lower universal joint members.

6. The vacuum cleaner of claim 5, wherein said collar is rotatably mounted to said lower universal member about said second axis.

7. The vacuum cleaner of claim 1, wherein said link means is provided by at least one annular locking rib extending inwardly from said lower universal joint member, and interlocking with at least one annular locking rib extending outwardly from said upper universal joint member.

* * * * *

UNITED STATES PATENT AND TRADEMARK OFFICE

CERTIFICATE OF CORRECTION

PATENT NO. : 5,323,510
DATED : June 28, 1994
INVENTOR(S) : Redding, et al

It is certified that error appears in the above-indentified patent and that said Letters Patent is hereby corrected as shown below:

Column 4, line 23, claim 1, the last word is changed from "right" to --"left" --.

Signed and Sealed this

Twenty-ninth Day of August, 1995

Bruce Lehman

*Attest:*

BRUCE LEHMAN

*Attesting Officer*

*Commissioner of Patents and Trademarks*